US010946240B2

(12) United States Patent
Carter

(10) Patent No.: US 10,946,240 B2
(45) Date of Patent: Mar. 16, 2021

(54) GLUTE MACHINE

(71) Applicant: TuffStuff Fitness International, Inc., Chino, CA (US)

(72) Inventor: Kenneth Evans Carter, Claremont, CA (US)

(73) Assignee: TuffStuff Fitness International, Inc., Chino, CA (US)

( * ) Notice: Subject to any disclaimer, the term of this patent is extended or adjusted under 35 U.S.C. 154(b) by 46 days.

(21) Appl. No.: 16/214,994

(22) Filed: Dec. 10, 2018

(65) Prior Publication Data

US 2020/0179750 A1 Jun. 11, 2020

(51) Int. Cl.

| | |
|---|---|
| ***A63B 23/04*** | (2006.01) |
| ***A63B 21/062*** | (2006.01) |
| ***A63B 21/00*** | (2006.01) |
| ***A63B 23/035*** | (2006.01) |
| ***A63B 21/06*** | (2006.01) |

(52) U.S. Cl.

CPC ..... *A63B 23/0429* (2013.01); *A63B 21/0615* (2013.01); *A63B 21/0628* (2015.10); *A63B 21/154* (2013.01); *A63B 21/4034* (2015.10); *A63B 21/4035* (2015.10); *A63B 23/03508* (2013.01); *A63B 2208/0295* (2013.01)

(58) Field of Classification Search

CPC ..... A63B 23/0429; A63B 21/0615; A63B 21/4034; A63B 21/0628; A63B 21/4035; A63B 23/03508; A63B 21/1554; A63B 2208/0295; A63B 23/00; A63B 23/035–0405

See application file for complete search history.

(56) References Cited

U.S. PATENT DOCUMENTS

| | | | | |
|---|---|---|---|---|
| 5,236,406 | A | 8/1993 | Webber | |
| 5,334,120 | A * | 8/1994 | Rasmussen | A63B 21/0615 482/101 |
| 5,352,171 | A * | 10/1994 | Lin | A63B 21/00072 482/137 |
| 5,401,227 | A | 3/1995 | Webber | |
| 5,681,247 | A | 10/1997 | Webber | |
| 5,733,233 | A | 3/1998 | Webber | |
| 5,800,321 | A | 9/1998 | Webber | |
| 5,938,574 | A | 8/1999 | Webber | |
| 5,961,428 | A | 10/1999 | Webber | |
| 5,980,434 | A | 11/1999 | Webber | |
| D431,615 | S | 10/2000 | Webber et al. | |
| D444,518 | S | 7/2001 | Webber | |
| 6,264,586 | B1 | 7/2001 | Webber | |
| 6,264,588 | B1 * | 7/2001 | Ellis | A63B 21/068 482/100 |

(Continued)

*Primary Examiner* — Andrew S Lo
(74) *Attorney, Agent, or Firm* — Husch Blackwell LLP

(57) ABSTRACT

A weight resistance training machine is provided that is used to exercise the glute muscles of a user. The weight resistance training machine includes a carriage member that a user may mount to use the training machine. The carriage member may be mounted on a track system that allows the carriage member to translate linearly when the weight training machine is used. When a foot press bar connected to the carriage member is extended, the carriage member is linear translated by a cable and pulley system to increase the muscle path length during exercise and increase the exercise's efficacy.

23 Claims, 15 Drawing Sheets

(56) References Cited

U.S. PATENT DOCUMENTS 6,287,241 B1 * 9/2001 Ellis ..... A63B 21/06 482/100
6,319,178 B1 11/2001 Webber
6,443,878 B1 9/2002 Webber
6,916,278 B2 * 7/2005 Webber ..... A63B 21/068 482/72
7,052,444 B2 5/2006 Webber
7,322,911 B2 1/2008 Webber
7,335,145 B2 2/2008 Webber
7,468,024 B2 12/2008 Webber et al.
7,563,209 B2 7/2009 Webber et al.
7,594,880 B2 9/2009 Webber et al.
7,654,940 B2 2/2010 Webber et al.
7,749,143 B2 7/2010 Webber
7,794,372 B1 9/2010 Webber et al.
7,867,149 B1 1/2011 Webber et al.
7,878,953 B2 2/2011 Webber et al.
7,901,335 B2 3/2011 Webber et al.
7,901,337 B2 3/2011 Webber et al.
7,938,760 B1 5/2011 Webber et al.
7,963,890 B2 6/2011 Webber et al.
7,981,010 B1 7/2011 Webber et al.
7,981,011 B1 * 7/2011 Batca ..... A63B 21/0628 482/100
7,988,603 B2 * 8/2011 Webber ..... A63B 21/0628 482/100
8,002,679 B2 * 8/2011 Webber ..... A63B 21/0628 482/72
8,162,807 B1 4/2012 Webber et al.
8,172,732 B1 5/2012 Webber et al.
8,262,543 B1 * 9/2012 Batca ..... A63B 23/03525 482/100
8,562,496 B2 10/2013 Webber et al.
8,702,573 B2 4/2014 Hockridge et al.
8,734,304 B2 * 5/2014 Webber ..... A63B 21/0628 482/140
8,852,060 B1 10/2014 Webber et al.
9,750,969 B2 * 9/2017 Carter ..... A63B 23/1209
9,950,210 B2 4/2018 Meredith et al.
10,226,665 B2 * 3/2019 Kordecki ..... A63B 21/4009
10,391,351 B2 * 8/2019 Carter ..... A63B 21/4045
2001/0018387 A1 8/2001 Webber
2002/0013199 A1 * 1/2002 Giannelli ..... A63B 21/068 482/95
2002/0103060 A1 8/2002 Webber
2003/0232703 A1 12/2003 Webber
2004/0009857 A1 * 1/2004 Webb ..... A63B 23/0405 482/100
2006/0122045 A1 6/2006 Webber
2006/0217249 A1 9/2006 Webber
2006/0287167 A1 12/2006 Bingham et al.
2007/0037673 A1 * 2/2007 Giannelli ..... A63B 21/068 482/95
2007/0225135 A1 9/2007 Webber
2008/0051265 A1 2/2008 Webber
2008/0058177 A1 3/2008 Webber et al.
2008/0113850 A1 5/2008 Webber et al.
2008/0132389 A1 6/2008 Webber et al.
2008/0153677 A1 6/2008 Webber et al.
2008/0214367 A1 9/2008 Webber et al.
2008/0248929 A1 10/2008 Webber et al.
2010/0016128 A1 1/2010 Webber et al.
2010/0323853 A1 12/2010 Webber et al.
2011/0224052 A1 9/2011 Webber et al.
2011/0224058 A1 9/2011 Webber et al.
2011/0287905 A1 * 11/2011 Reyes ..... A63B 21/00072 482/94
2012/0100970 A9 4/2012 Webber et al.
2012/0277069 A1 11/2012 Hockridge et al.
2013/0281271 A1 * 10/2013 Nizam ..... A63B 23/03558 482/139
2016/0082315 A1 * 3/2016 Carter ..... A63B 23/0494 482/94
2016/0184630 A1 6/2016 Meredith et al.
2017/0106234 A1 * 4/2017 Carter ..... A63B 23/1209
2017/0106235 A1 * 4/2017 Carter ..... A63B 23/1209
2018/0085621 A1 3/2018 Webber et al.
2018/0133536 A1 5/2018 Webber et al.
2018/0200573 A1 7/2018 Meredith et al.

* cited by examiner

GLUTE MACHINE

FIELD OF THE INVENTION

The present invention is generally directed to fitness equipment, and more particularly to a resistance weight training machine for efficiently and effectively exercising a user's gluteus maximus muscles.

BACKGROUND OF THE INVENTION

Resistance training is a popular form of exercise where a user moves his or her limbs against some form of resistance, such as weighted bars, dumbbells, or the like. Users ranging from recreational fitness enthusiasts to professional bodybuilders often use resistance training to become stronger, more flexible, more agile, and/or to increase overall fitness. Resistance training can also help reduce the likelihood of injury. Resistance weight training machines are fixtures at gyms and recreation centers across the world. Unfortunately, many systems currently on the market are not as effective as they could be at increasing muscle strength.

For example, in a traditional "cable lat pulldown exercise" where the latissimus dorsi muscles are exercised, a weight machine with a seat and brace for the thighs is typically utilized. A user begins in a seated position with his or her thighs braced, back straight, and feet flat on the floor. A user places his or her arms overhead at full extension in order to grasp a bar connected to the weight stack, for example via a cable and pulley system. A user may then pull his or her elbows downwardly and rearwardly to pull the bar towards the neck in order to lift the weight stack, before returning to the initial position. Throughout the exercise, the machine's seat remains fixed.

Because the machine's seat remains fixed, a user may be in an unnatural position during exercise. Moreover, a user may not carry out the exercise in a manner that sufficiently lengthens the user's muscles during exercise. Such traditional training machines are less effective at increasing muscle strength, and could even lead to injury.

The glute muscles are a well-known group of muscles that fitness enthusiasts and professionals alike work hard to strengthen. Because of the biomechanical positioning required to properly exercise the glutes, an increased muscle length has been difficult to achieve using existing equipment. Thus, an alternatively constructed multiple movement plane is desired that is able to still increase muscle path length and be an efficient and effective tool for strengthening the glutes.

SUMMARY OF INVENTION

A resistance weight training machine including multiple movement planes for effectively and efficiently exercising the glute muscles is provided. The resistance weight training machine, hereinafter referred to as the "weight training device" or "glute machine," operates using a series of pulleys and cables. The weight training device includes a weight stack and a linear translating carriage member in order to allow for improved exercise. More particularly, the glute machine allows a user to extend his or her leg associated with the glute muscle being exercised to drive forward linear translation of the carriage member. At substantially the same time, the carriage member drives weight in the weight stack to be lifted, thus providing resistance to the glute being exercised.

The weight training device generally may include each of a weight rack assembly and a user operation assembly. The weight rack assembly, like prior art weight training devices, includes a weight stack that can be lifted when a user operates the machine in the manner described below to lift weight from, and subsequently return weight to, the weight stack.

The user operation assembly may be made up of a translating carriage member including a kneeling pad, handle assembly, and a foot press bar. The kneeling pad is preferably positioned such that when a user is either resting or operating the weight training device, he or she faces downwardly with his or her knee opposite the glute muscle being exercised preferably resting on the kneeling pad. As described below, when the user exercises using the weight training device, the carriage member including the kneeling pad may translate in a forward direction to increase exercise efficiency. When a user is mounted on the weight training device, he or she may also grip the handle assembly. The foot press bar is preferably attached to the user assembly behind the user's feet and is preferably in communication with a pulley system that controls the weight stack via the carriage member.

Various rigid structural components may fixedly attach the weight rack assembly and user operation assembly to one another. However, the two assemblies are also preferably in communication with one another via a cable and pulley system. More particularly, a first cable and the pulley system preferably connects the machine's foot press bar to the carriage member. Thus, when the user presses rearwardly on the foot press bar, a first cable and pulley system connecting the foot bar to the carriage member translates the movement to the carriage member such that the carriage member and knee pad are forwardly translated. Almost simultaneously, a second cable and pulley system that connects the carriage member and weight stack to one another preferably causes a portion of weight from the weight stack to be lifted.

When ready to operate the machine, the user should be face down. His or her first leg (not being exercised) rests on the kneeling pad associated with the carriage member, while his or her second leg (being exercised) extends rearwardly with his or her foot positioned on the foot press bar. Then, to operate the machine, the operator may press his or her foot rearwardly against the foot bar to set the foot bar in a rearward arc movement. This motion may drive the carriage member into forward linear motion via the first cable and pulley system. The carriage member may then drive the weight stack to be lifted via the second cable and pulley system, thus providing a resistance force against the user's glute associated with the second leg with which he or she is pushing.

The carriage member and kneeling pad, as described above, is linearly translatable. More particularly, the kneeling pad is attached to the user operation assembly by a track system that allows the kneeling pad to linearly translate from the rear portion to the front portion (and vice versa) of the user operation assembly. When the user pushes rearwardly against the foot press bar as described above with the second leg, the carriage member and thus the first leg resting on the kneeling pad (as well as the rest of the operator's body) are driven forward to counter the push with the second leg. Thus, the kneeling pad translates along a linear path to allow the user to lengthen the muscle path when he or she is operating the machine by pressing rearwardly on the foot bar.

Not only will the kneeling pad slide forward, but the user's upper body as a whole will also preferably slide forward along with the kneeling pad and the handle assembly attached to the kneeling pad. When the operator brings his or her foot operating the foot bar back toward his or her body, his or her upper body, and thus the kneeling pad, may translate back toward the rear of the device as the weight stack returns to its unlifted position. This process may be repeated for each repetition of exercise that the operator completes within a set. The linear movement of the carriage member during the rearward extension of the leg associated with the glute being exercised allows for the elongated muscle length path that improves the exercise's efficacy.

Because the machine may be used to exercise each of the right and left glute, the knee pad may be adjustable to allow either knee to rest thereon when the other leg is being exercised. While many mechanisms may be used to adjust the kneeling pad to either of the right or left leg, in a preferred embodiment, the kneeling pad may be attached to the operation assembly by a post on which the kneeling pad may swivel to be in either of the left or right position. Other mechanisms are foreseeable, but in any event, the mechanism should be one that is simple and effective such that any operator may quickly and easily adjust the kneeling pad from one side to the other with little interruption to his or her exercise routine.

DETAILED DESCRIPTION OF THE INVENTION

Figure 1:
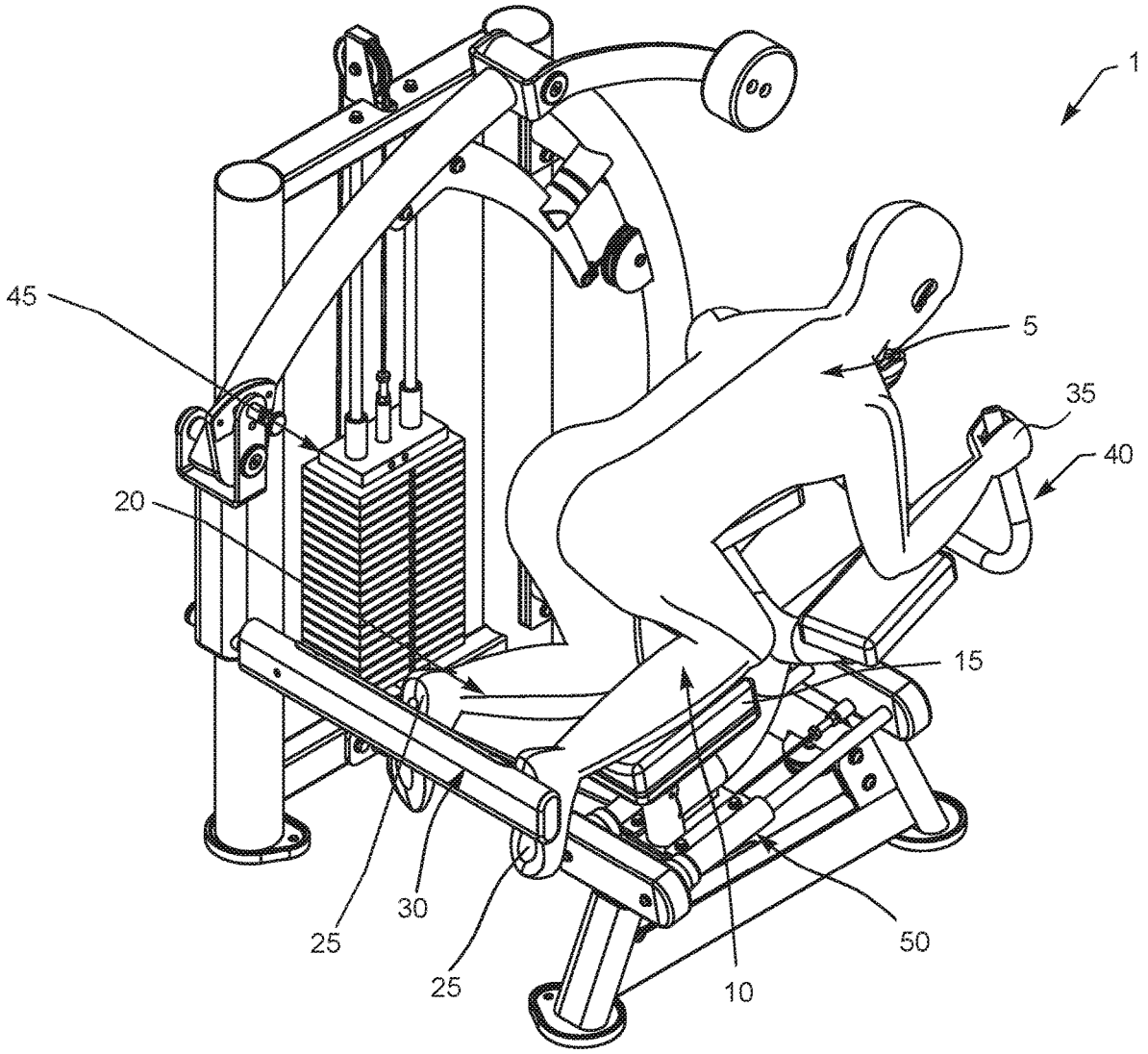
FIG. 1 is a perspective view of a person mounted on a glute machine constructed according to the teachings of the present invention in a start position.

The present disclosure is directed to resistance training exercise equipment, and more particularly to a resistance weight training machine for efficiently and effectively exercising a user's gluteus maximus muscles, referred to herein as "glute machine" 1. Turning first to FIG. 1, the glute machine 1 is illustrated in a start position. The start position refers to the position that the glute machine 1 is in when "at rest" or before a person such as person 5 has mounted the glute machine 1 prior to commencing exercise, as will be described below.

In the start position, the person 5 is facing downwards. In a preferred embodiment, a resting leg, in this case the right leg 10 of the person 5, may rest on a kneeling pad 15 of the glute machine 1. An active leg 20 of the person 5, which is associated with a glute muscle to be exercised, may be substantially free to move. At least one foot 25 of the person 5 may be placed so that it abuts a foot press bar 30 of the glute machine 1. In the start position, hands 35 of the person 5 preferably grasp a handle assembly 40 associated with the glute machine 1.

When the person 5 is ready to commence exercise, he or she pushes rearwardly with the active leg 20. As the person 5 pushes rearwardly with the foot 25 of the active leg 20, the foot press bar 30 is similarly pushed rearwardly and upwardly in an arc-like manner. This motion initiates two mechanical processes. First, weight associated with the weight stack 45 of the glute machine 1 is lifted or otherwise activated, thus providing resistance to the glute muscle being exercised. Second, a carriage member 50 on which the person 5 is resting (via the kneeling pad 15) is linearly translated in a forward direction. The specific mechanisms that allow for the weight stack 45 to be lifted and the carriage member 50 to be linearly translated are described in greater detail below.

Figure 2:
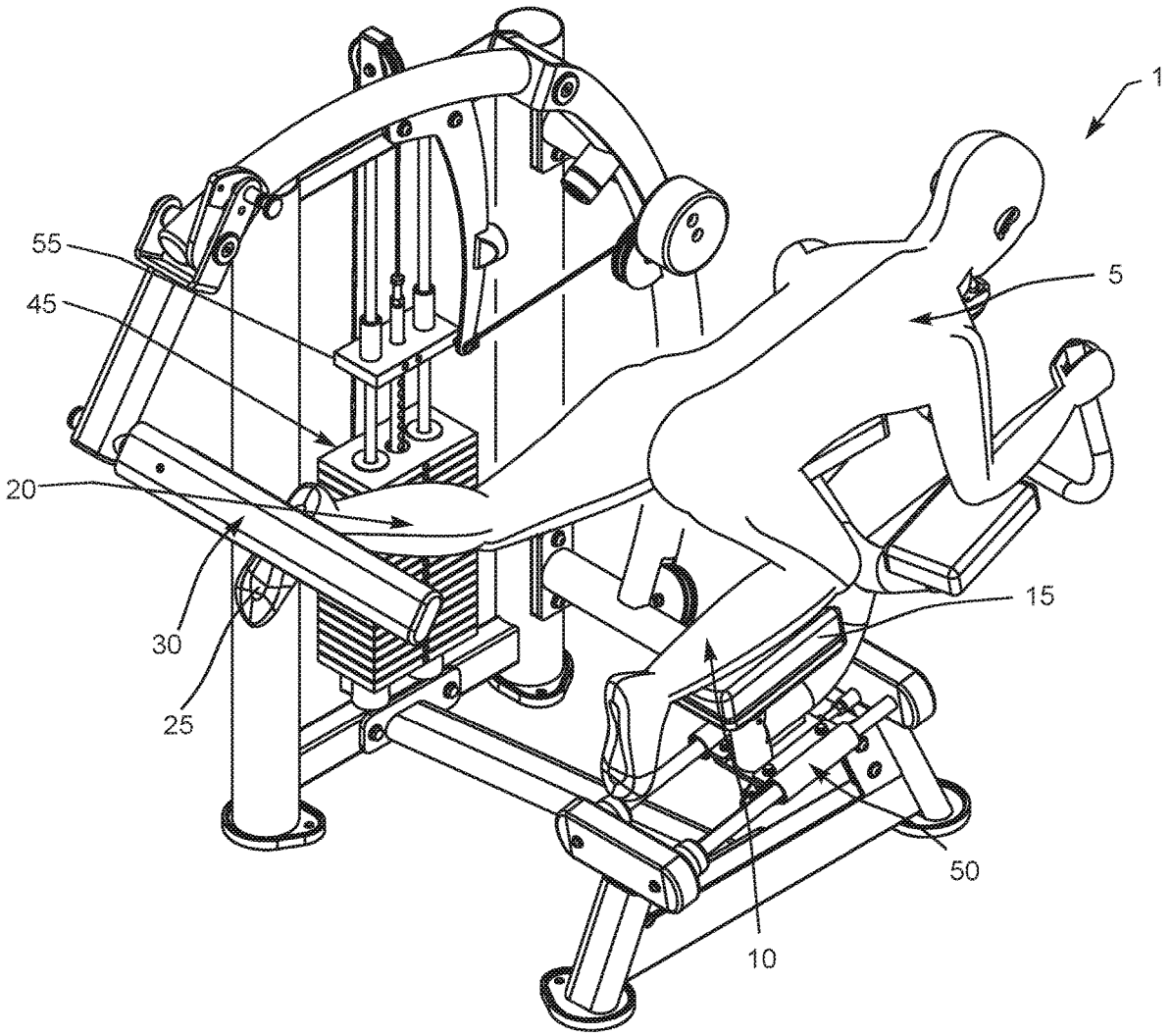
FIG. 2 is a perspective view of the glute machine and a person mounted thereon in an end position.

Turning now to FIG. 2, the glute machine 1 and the person 5 are illustrated in what is referred to herein as the end position. In the end position, the person 5 has extended a foot 25 of the active leg 20 rearwardly, thereby forcing the foot press bar 30 to an extended position. In some embodiments, this extended position may be representative of the maximum distance that the foot press bar 30 is able to rearwardly move. In the end position, a portion 55 of the weight stack 45 has been lifted by mechanisms described below that are initiated by the person 5 extending the foot 25 of his or her active leg 20. This portion 55 of the weight stack 50 is representative of the weight that resists movement of the active leg 20 of the person 5.

In the end position, the carriage member 50 has also been forwardly linearly translated. With the foot press bar 30 rearwardly extended by the active leg 20, and the person 5 forwardly linearly translated via the carriage member 50, the muscle path length of the glute muscle being exercised is greater than if only the foot press bar 30 were rearwardly extended.

The embodiments illustrated in FIG. 1 and FIG. 2 show only two positions (particularly the start and end positions) that a person 5 and the equipment 1 may assume during exercise. However, as will be appreciated and understood in view of the additional description that follows, a limitless number of positions between those illustrated in FIG. 1 and FIG. 2 are possible depending on the actions and position of a person 5 in any particular exercise repetition. It should be noted that the general movement described above that takes the person 5 and the glute machine 1 into the start and end positions may be reproduced continuously or intermittently to meet the exercise preferences of the person 5 (i.e., carrying out a certain number of repetitions and sets within an exercise session).

Moreover, it should be noted that the person 5 may perform the exercises described above and below (in greater detail) for the opposite leg (the resting leg 10) by switching the relative positions of the legs 10, 20. More particularly, the active leg 20 may be placed on the kneeling pad 15, while the resting leg 10 is left free to move and subsequently be rearwardly extended. This would of course cause what was originally the rest leg 10 to become the active leg 20, and vice versa.

Figure 3:
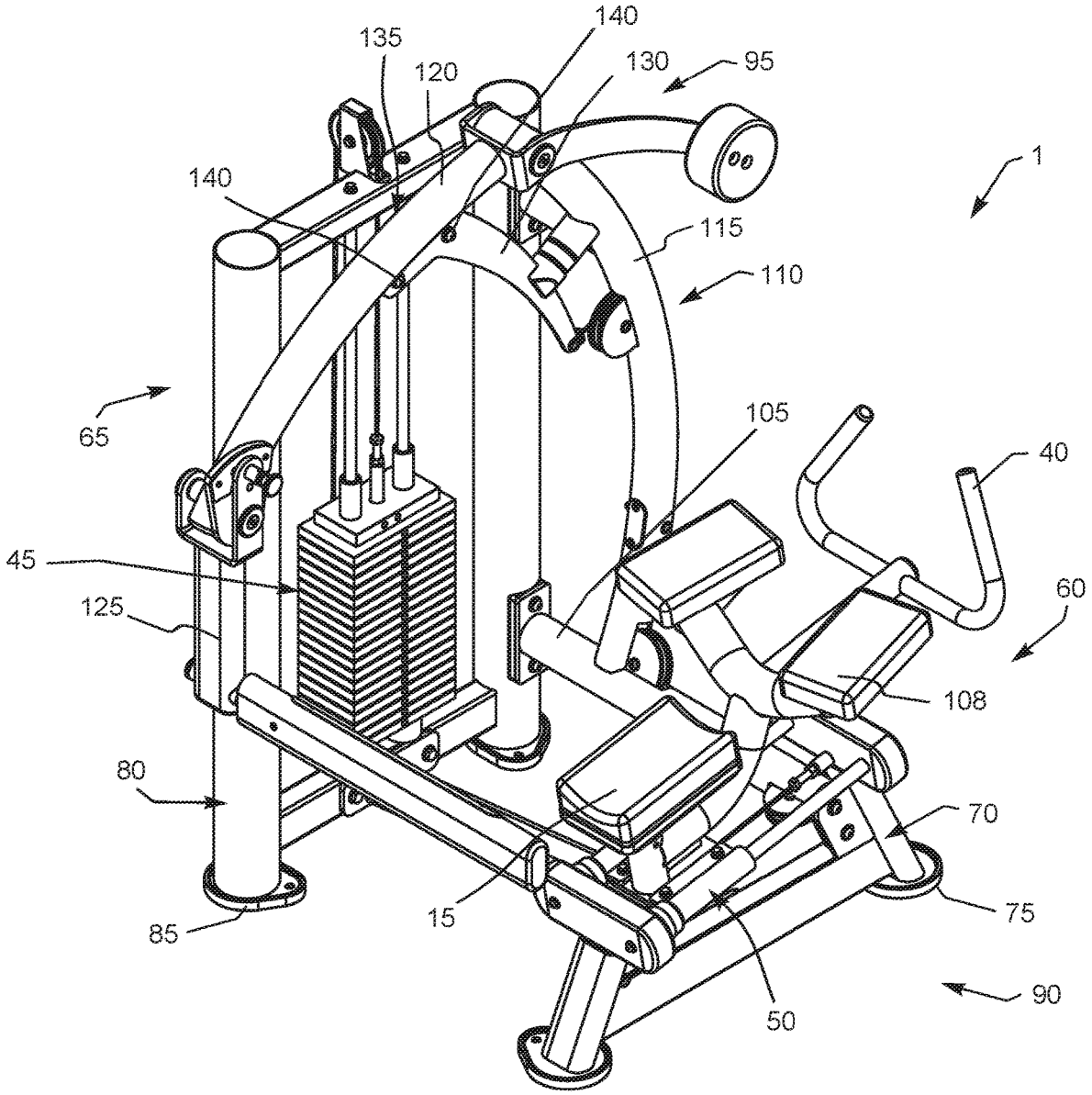
FIG. 3 is a perspective view of the glute machine in the start position without a person mounted thereon.
Figure 4:
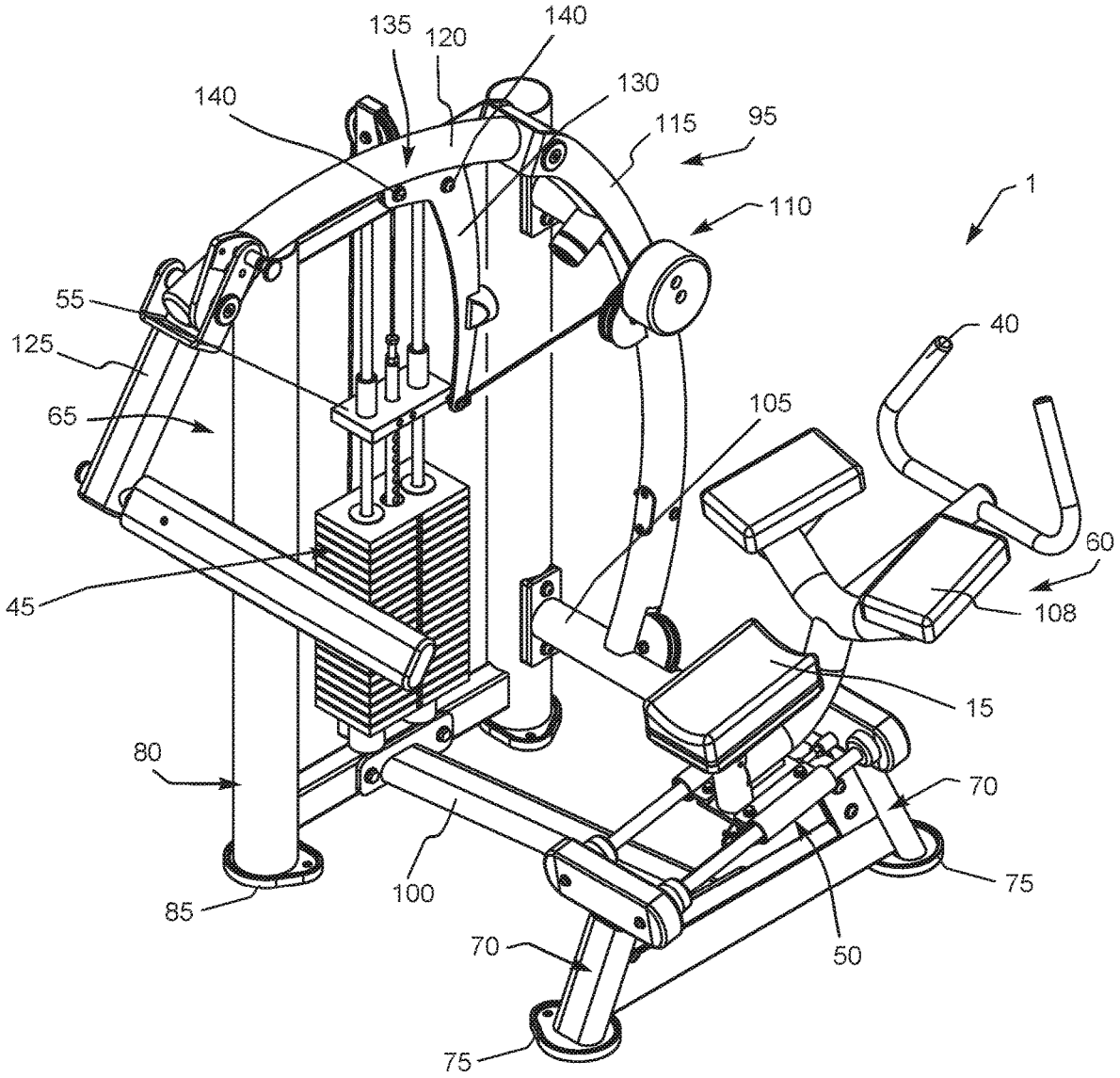
FIG. 4 is a perspective view of the glute machine in the end position without a person mounted thereon.

In FIGS. 3 and 4, the glute machine 1 is shown in the start position and the end position, respectively. However, in FIGS. 3 and 4, the person 5 is no longer illustrated, and thus details regarding the construction and assembly of the glute machine 1 are more unobstructedly illustrated.

The glute machine 1 generally may include a user assembly 60 and a weight rack assembly 65. User assembly 60 and the weight rack assembly 65 may be assembled such that they are attached to one another in a side by side configuration. Each of the assemblies 60, 65 may include leg members and foot members to act as a base for the glute machine 1, but alternative embodiments may be constructed using other known or foreseeable structures. More particularly, the legs of the user assembly 60 are provided as angled leg members 70 each having a foot 75, while the leg members of the weight rack assembly 65 are embodied as upright, vertical leg members 80 each having a foot 85. The feet 75, 85 may be level with one another so that when the glute machine 1 is placed on a level surface such as those commonly used in exercise rooms and facilities, the glute machine 1 is level. In alternative embodiments, the feet 75, 85 and/or leg members 70, 80 may be adjustable to change the height of the glue machine 1, or may take any other form.

Preferably, the user assembly 60 and the weight rack assembly 65 are connected at a lower portion 90 of the glute machine 1, although other structures are envisioned. More particularly, in the embodiment of the glute machine 1 illustrated herein, the user assembly 60 and the weight rack assembly are connected by a central cross brace 100 (see FIG. 4) and a front cross brace 105.

An upper portion 95 of the glute machine 1 as shown does not include any direct connections between the user assembly 60 and the weight rack assembly 65. With no connections between the user assembly 60 and the weight rack assembly 65 at the upper portion 95 of the glute machine 1, it is often easier for a person such as the person 5 to mount and unmount the glute machine 1 to exercise. However, an upper direct connection may be used where desired or useful for more stability.

Turning to the weight rack assembly 65, the weight stack 45 associated with the weight rack assembly 65 may be substantially similar to weight stacks that are commonly used and well understood in the art of exercise equipment. However, other suitable resistance structures are also envisioned. As will be described in great detail herein below, when the foot press bar 30 is pressed rearwardly, a portion (embodied as portion 55 in FIG. 4) is lifted from the weight stack 45 to resist a glute muscle of the person using the glute machine 1. The cable and pulley system that lifts the weight stack 45 and any portion thereof such as the portion 55 is described in greater detail herein below.

The carriage member 50 may be linearly translatable such that it is in a more rearward position (closer to the foot press bar 30) in the start position and more forwardly (closer to the front cross brace 105) in the end position. The carriage member 50, as referenced above, preferably includes each of the kneeling pad 15 as well as the handle assembly 40 for gripping by a person 5. Moreover, the carriage member preferably includes optional wrist or forearm pads 108 upon which a person such as the person 5 may place and rest his or her forearms when using the glute machine 1.

In the embodiment illustrated in FIGS. 3 and 4, the carriage member 50 is assembled to the glute machine 1 such that it is substantially above and in line with the leg members 70. By having the carriage member 50 assembled within the glute machine 1 above the leg members 70, the leg members 70 provide additional support to the carriage member 50 as it substantially supports the weight of the person 5. The manner in which the carriage member 50 translates between its back or rear position and its front position is described in greater detail below.

An articulating arm member 110 may be positioned between the carriage member 50 and the weight stack assembly 65. The articulating arm member 110, as shown, preferably extends upwardly and rearwardly from the front cross brace 105, though other paths for the arm member 110 are foreseeable. In a preferred embodiment, the articulating arm member 110 preferably includes each of a first arm section 115, second arm section 120 and a third arm section 125. The first arm section 115, which is rigidly attached to the front cross brace 105, may extend upwardly therefrom. In this embodiment, the first arm section 115 preferably remains fixed during use of the glute machine 1. The second arm section 120 is then preferably hingedly attached to the first arm section 115 and extends rearwardly therefrom. Similarly, the third arm section 125 is preferably hingedly attached to the second arm section 120 and extends rearwardly therefrom. Moreover, the foot press bar 30 would preferably be perpendicularly attached to the third arm section. It may project inwardly toward the carriage member 50 so that when a person has mounted the glute machine 1 to exercise, and his or her legs such as the legs 10, 20 of FIGS. 1 and 2 are rearwardly extended, they may come into contact with the foot press bar 30.

In a preferred embodiment, the second arm section 120 of the articulating arm member 110 also includes an extension arm member 130 that is located near a middle section 135 of the arm section 120. The arm extension member 130 preferably is fixedly attached to the second arm section 120, for example by bolts 140, though other attachment means are contemplated herein. Motion of the articulating arm member 110, its sections 115, 120, 125, and the extension member 130 are described in greater detail herein below when also describing in greater detail the underlying cable and pulley system that together with the articulating arm member 110 and the carriage member 50 generates the movements of the glute machine 1.

Figure 5:
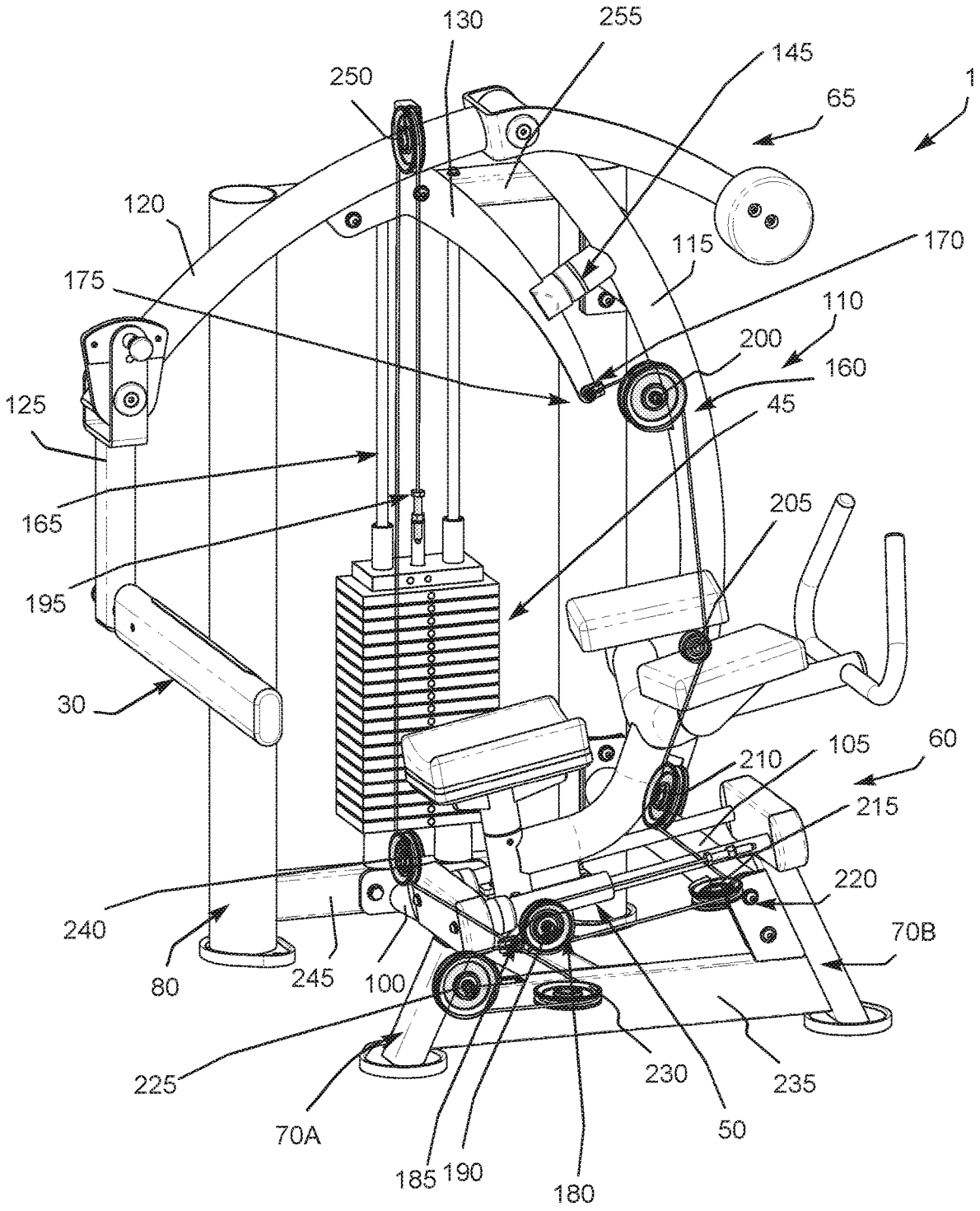
FIG. 5 is a perspective view illustrating an internal cable and pulley system of the glute machine in the start position.
Figure 6:
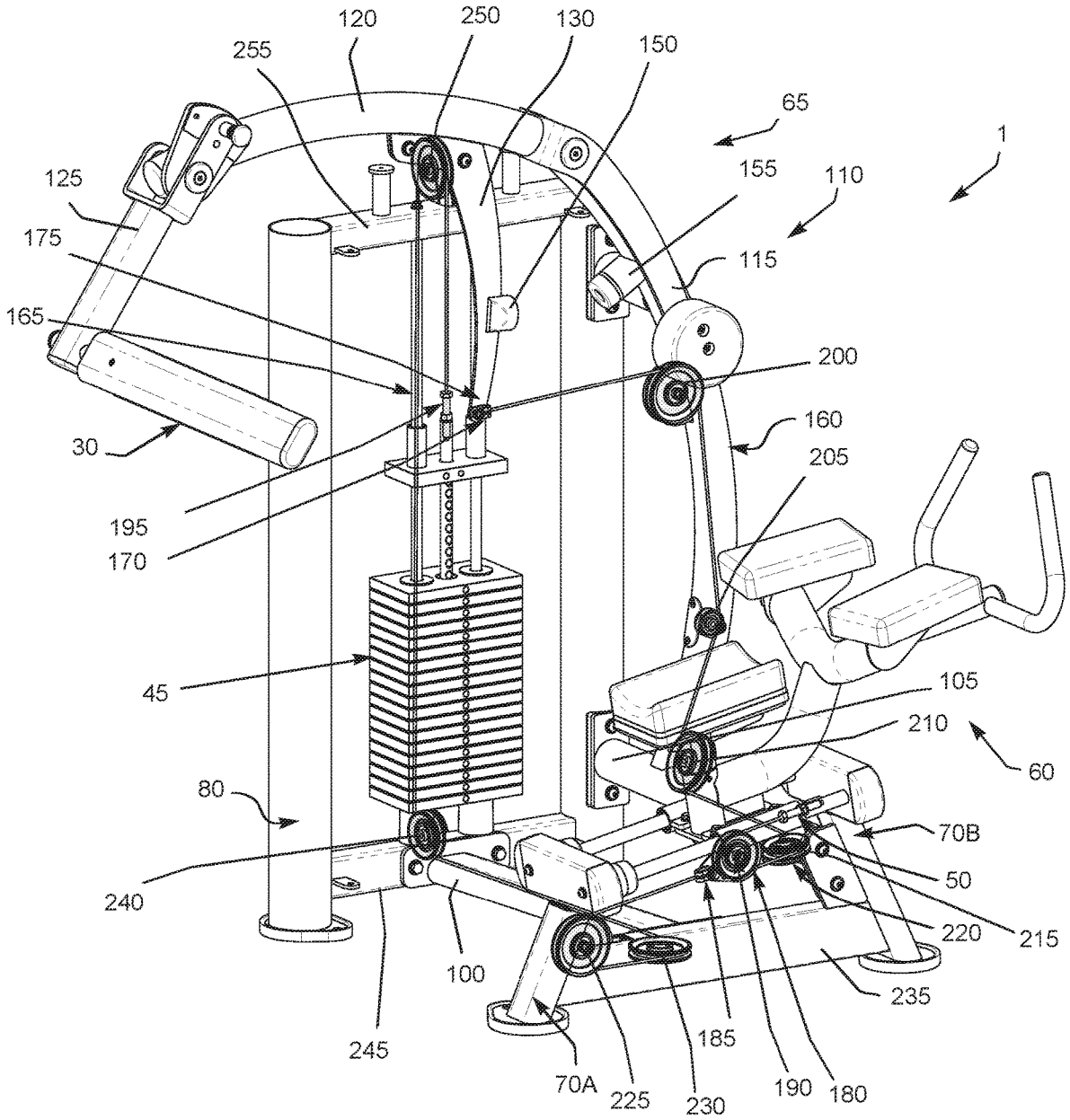
FIG. 6 is a perspective view illustrating the internal cable and pulley system of the glute machine in the end position.

Turning to FIGS. 5 and 6, a cable and pulley assembly, which preferably drives the motion of the carriage member 50 and the lifting of the weight stack 45, is shown and illustrated. When the glute machine 1 is in the start position illustrated in FIG. 5, the extension member 130 is preferably received and retained within a retaining member 145 extending rearwardly and attached to the first arm section 115 of the articulating arm member 110. The retaining member 145 is illustrated in greater detail in FIG. 6, where it is provided that the retaining member 145 comprises two portions. A first retaining member 150 is provided on the arm extension member 130, while a second retaining member 155 is provided on the first arm section 115. In one embodiment, retainer portions 150, 155 may be magnetized so that they are selectively coupled to one another, but other embodiments of the retaining member 145 are also contemplated herein.

When the glute machine 1 is activated by a person such as the person 5 (not illustrated in FIGS. 5 and 6), the foot press bar 30 is extended rearwardly by the force exerted by the person 5 and his or her foot associated with the glute muscle being exercised. As the foot press bar 30 is rearwardly extended, the third arm section 125 is preferably similarly rearwardly (and somewhat upwardly) extended along an arc-like path. Because the third arm section 125 and the second arm section 120 are hingedly attached with one another, the second arm section 120 is also moved rearwardly and upwardly. This may result in the extension arm member 130 moving rearwardly and upwardly. The general motion of the foot press bar 30, third arm section 125, second arm section 120, and arm extension member 130 may be extrapolated by seeing the relative position of those same components in FIGS. 5 and 6. Moreover FIGS. 9, 12, and 15 described below show those same various components when the glute machine 1 is in use.

In a preferred embodiment, two cables preferably operate together with various pulleys and guides to drive the motion of the carriage member 50 and the weight stack 45. More particularly, a first cable member 160 drives the carriage member 50 upon activation of the foot press bar 30 by a person. A second cable 165 may then translate the movement driven by the foot press bar 30 to the carriage member 50 from the carriage member 50 to the weight stack 45.

Turning first to the first cable 160, the cable 160 is attached to the arm extension member 130 at a first attachment point 170. The attachment point 170 is located at a distal end portion 175 of the arm extension member 130 opposite from where the arm extension member 130 is attached to the second arm section 120. However, other attachment points are envisioned. In a preferred embodiment, the first cable 160 is fixedly or semi-permanently attached to the arm extension member 130 at the first attachment point 170. At a second attachment point 180, the first cable 160 is preferably fixedly or semi-permanently attached to the carriage member 50.

The second attachment point 180 is preferably on a disc member having two attachment points as shown in FIGS. 5 and 6, though other attachment means are also foreseeable. Thus, a first attachment point 185 for the second cable 165 is also provided on disc member 190. Each of the first cable 160 and the second cable 165 are fixedly attached to the first attachment point 185. The second cable 165 has its first attachment point 185 where it is attached to the disc member 190 and also a second attachment point 195 where it is attached to the weight stack 45. Pulleys that help cause motion and/or lifting of the carriage member 50 in the weight stack 45, as well as guide members that help to keep the cables 160, 165 in their appropriate positions and alignments, are described below. While one cable system comprising the cables 160, 165 and various pulleys and guides used to drive the same are described below, one skilled in the art would appreciate and recognize that there are a number of ways in which the cable system made up of the cables 160, 165 may operate, and the system described below is exemplary in nature along and is not restrictive as to the variety of mechanisms and/or methods that may be utilized.

In the embodiment illustrated in FIGS. 5 and 6, the first cable 160 extends from its first attachment point 170 toward the first arm section 115 where a first pulley 200 is provided around which the first cable 160 is wrapped and redirected into the arm section 115 downwardly along the remainder of the length of the first arm section 115 such that the cable is guided through an interior portion of the first section 115. Toward a bottom, interior portion of the arm section 115, a guide member 205 is provided that may help to ensure that the first cable 160 stays on track. The first cable 160 preferably continues downwardly through the arm section 115 past the guide member 205 until it is received and engaged by a second pulley member 210.

The second pulley member 210 may be fixedly attached to the front cross brace 105. The second pulley member 210 helps redirect the first cable member 160 so that it is no longer traveling downwardly and instead is traveling outwardly in the direction of the carriage member 50 as well as the legs 70. In doing so, the first cable 160 remains contained in an interior of existing structures of the glute machine 1 and thus is guided from within the arm section 115 to within the front cross brace 105. The first cable 160 continues in the outward direction toward the leg members 70 until it reaches a third pulley member 215 located at a distal end 220 of the front cross brace 105.

The third pulley member 215 may then redirect the first cable 160 rearwardly toward the foot press bar 30. The first cable 160 may continue in this direction until it is attached to the carriage member 50 at the second attachment point 180 on the disc member 190.

With the first cable 160 fixedly attached to the carriage member 50, when the foot press bar 30 is extended rearwardly, the first cable 160 preferably acts on the carriage member 50 and causes it to translate forwardly. More particularly, a track system on which the carriage member is arranged allows the carriage member 50 to translate forwardly in a linear manner, as described and illustrated in greater detail in the figures that follow.

Turning now to the second cable 165, when the carriage member 50 is linearly translated via the first cable 160 in the manner described above, the second cable 165 is also preferably pulled. Like the first cable 160, the second cable 165 is guided and leveraged using a number of pulleys. The pulley system that guides movement of the second cable 165 is described below in one embodiment, but alternative embodiments that guide the cable 165 are also envisioned herein.

A first pulley 225 is provided that is attached to rear leg 70A of the user assembly 60. The pulley 225 preferably redirects the second cable 165 downwardly and toward the front direction until reaching a second pulley 230. In the distance between the first pulley 225 and the second pulley 230, the first cable 165 is preferably guided within the interior of a cross bar 235 connecting the rear leg 70A to a front leg 70B. The second pulley 230 may redirect the second cable 165 toward the weight stack assembly 65 by directing the second cable 165 through the central cross brace 100.

A third pulley 240 may be located at the intersection of the central cross brace 100 and a cross bar 245 that connects the legs 80 to one another. The third pulley 240 redirects the second cable 165 upwards along the weight stack 45 until reaching a fourth pulley 250 attached to an upper cross bar 255 connecting the legs 80 at their upper portion.

The fourth pulley 250 may redirect the second cable 165 downwardly until it is attached to the weight stack 45 at the attachment point 195. Thus, the second cable 165 may act to lift the weight stack 45 (or a portion thereof depending on a user's preference) when the carriage member 50 is linearly translated in a forward direction by the foot press bar 30.

Figure 7:
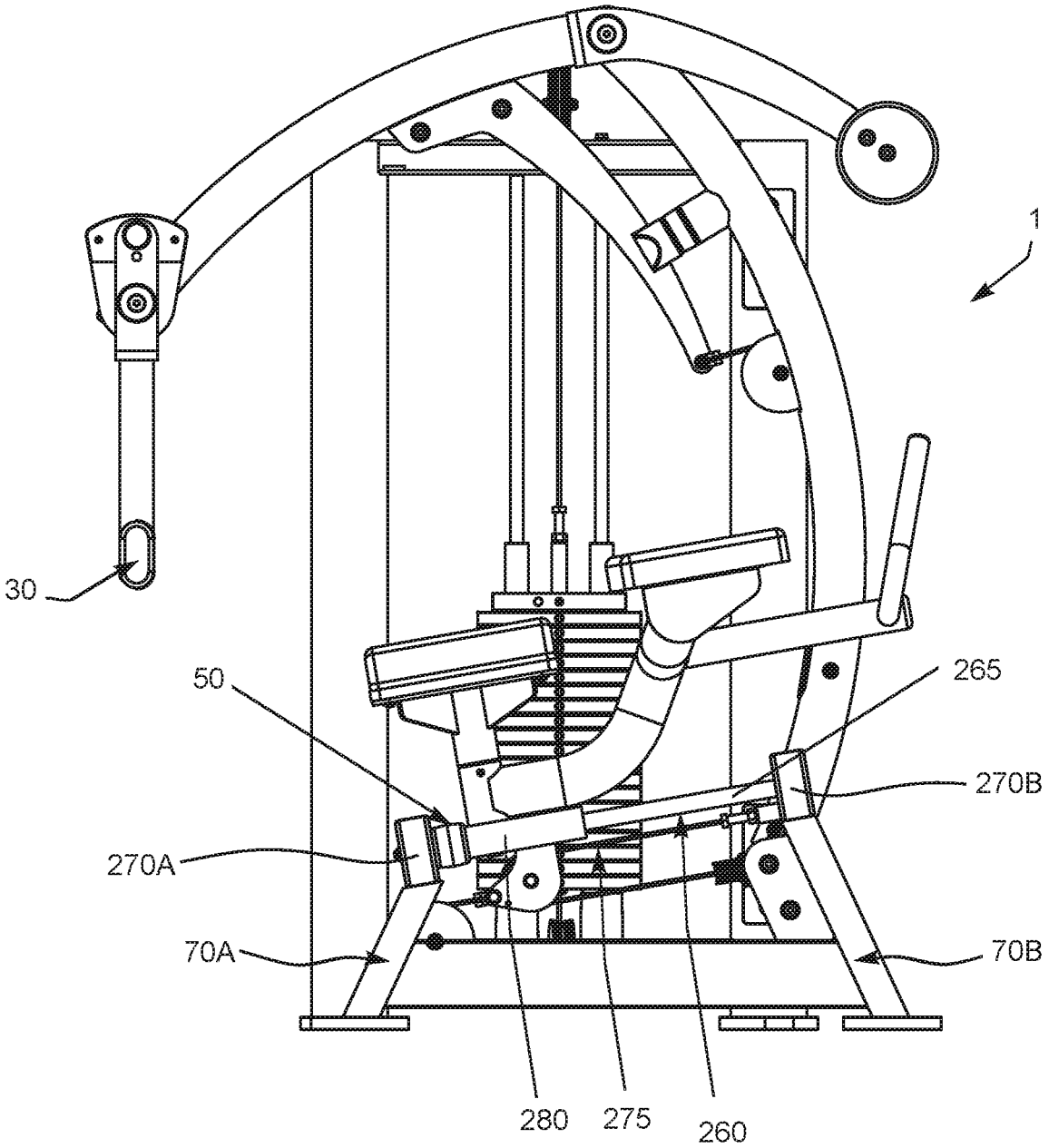
FIG. 7 is an elevation view of the glute machine in the start position without a person mounted thereon.
Figure 8:
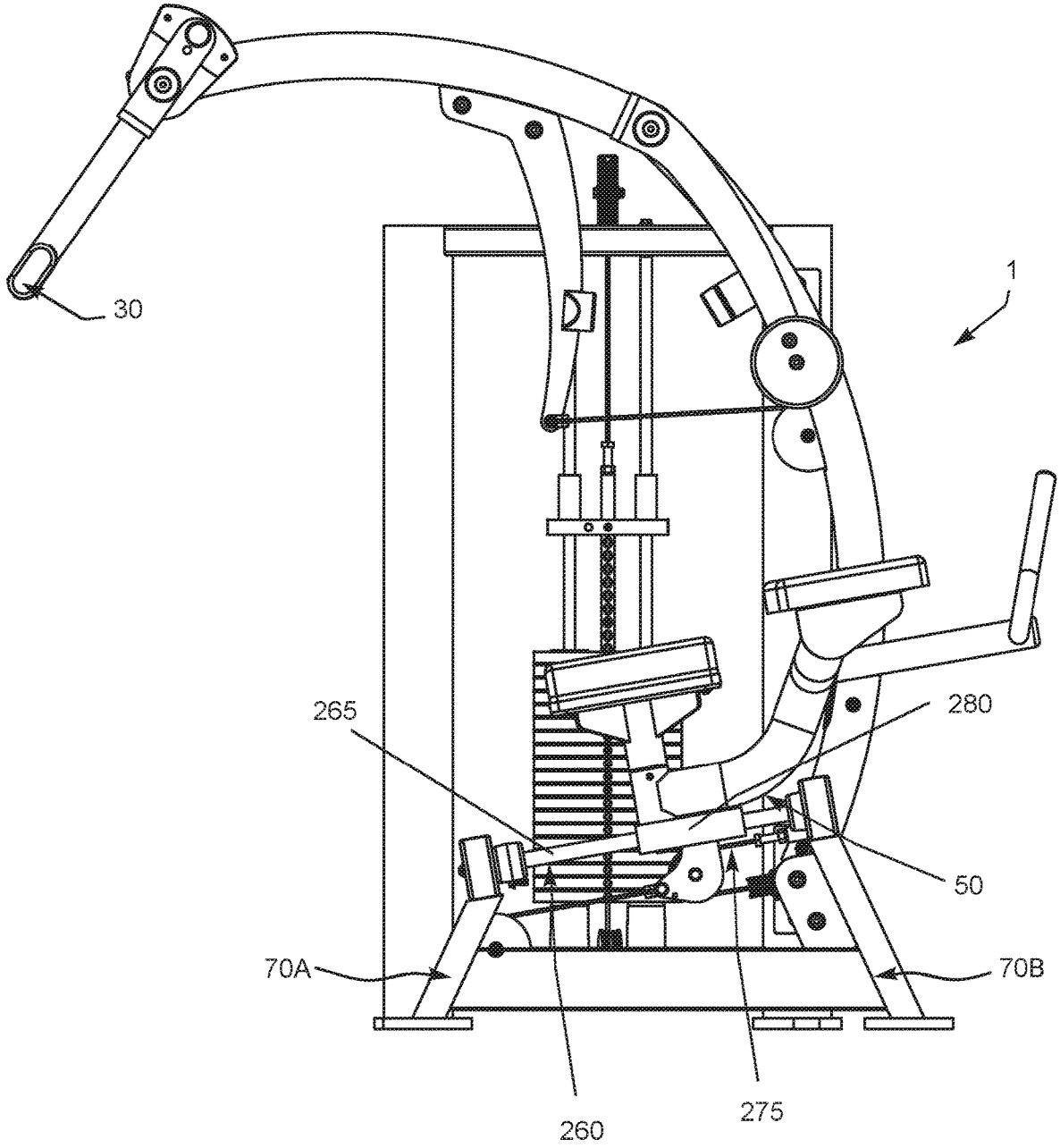
FIG. 8 is an elevation view of the glute machine in the end position without a person mounted thereon.
Figure 9:
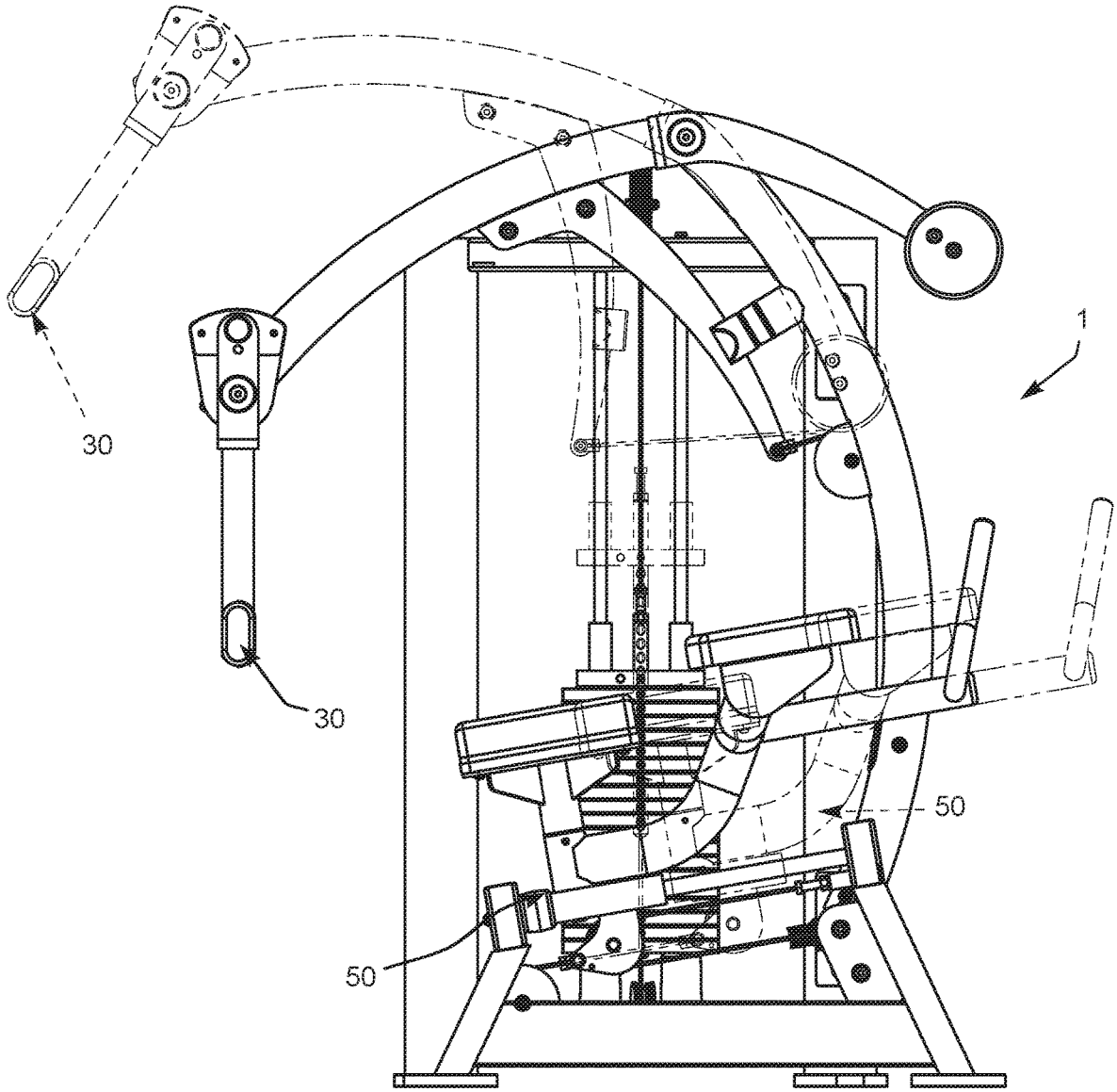
FIG. 9 is an elevation view of the glute machine in use without a person mounted thereon.
Figure 10:
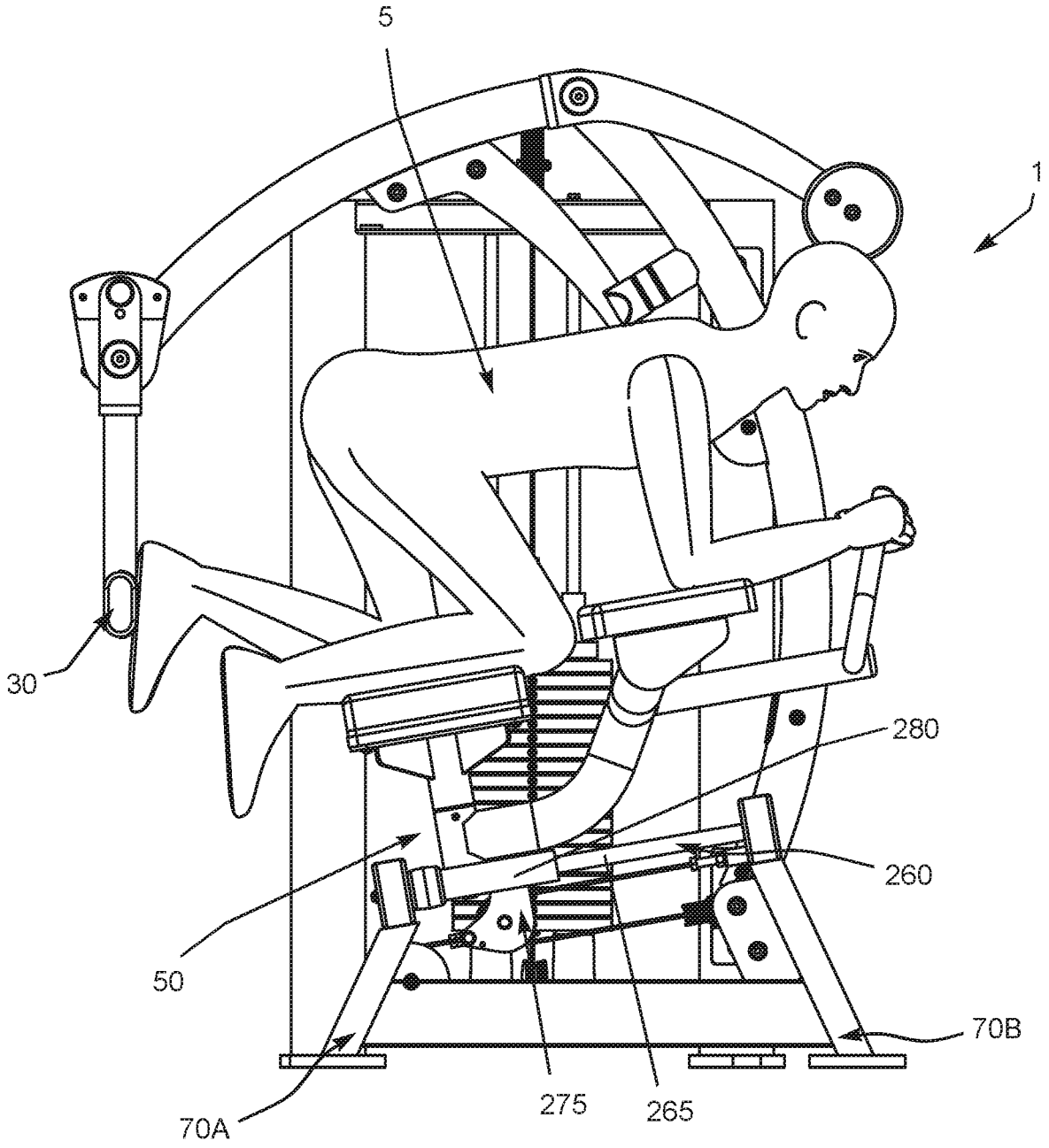
FIG. 10 is an elevation view of the glute machine in the start position with a person mounted thereon.
Figure 11:
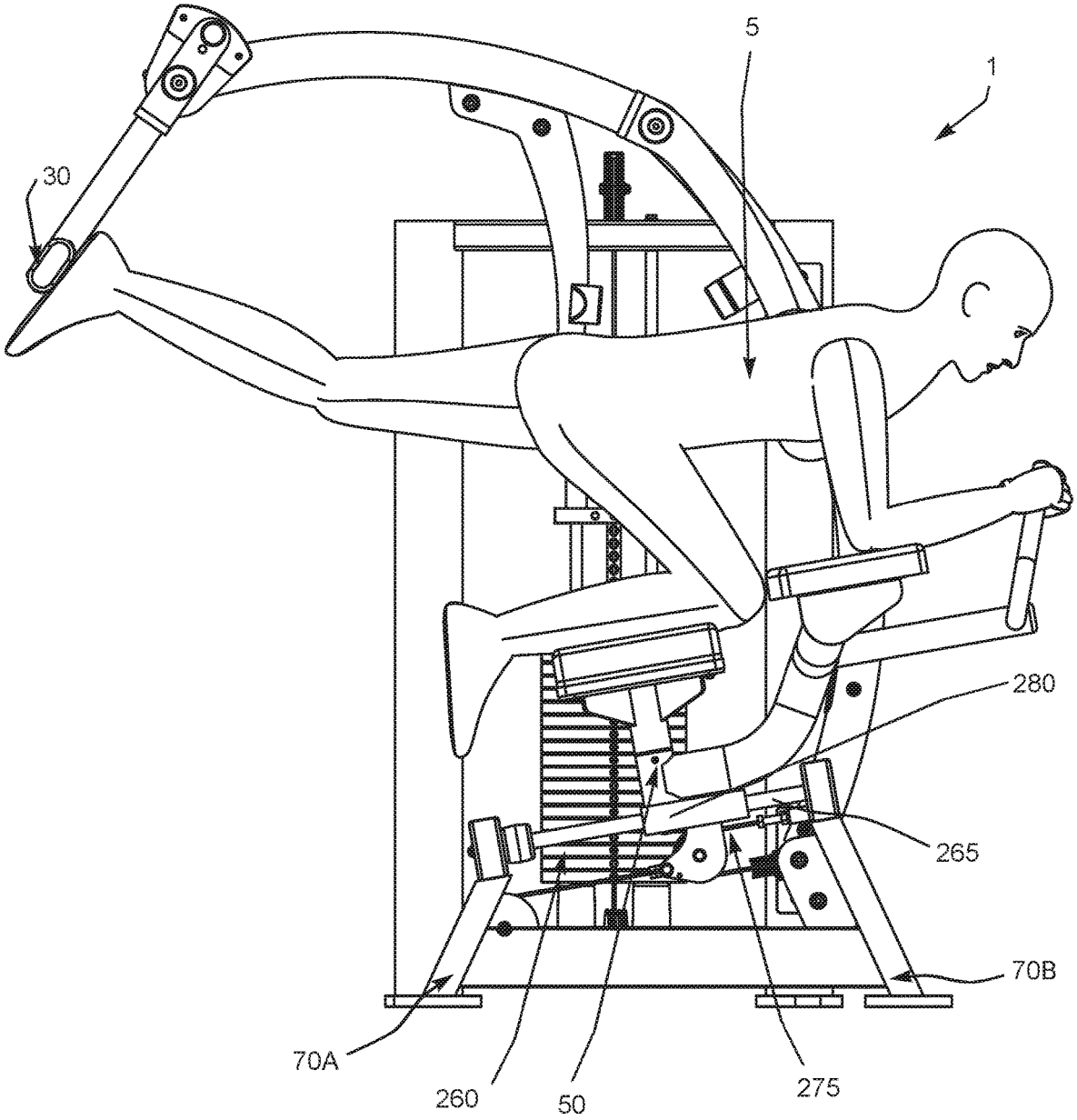
FIG. 11 is an elevation view of the glute machine in the end position with a person mounted thereon.
Figure 12:
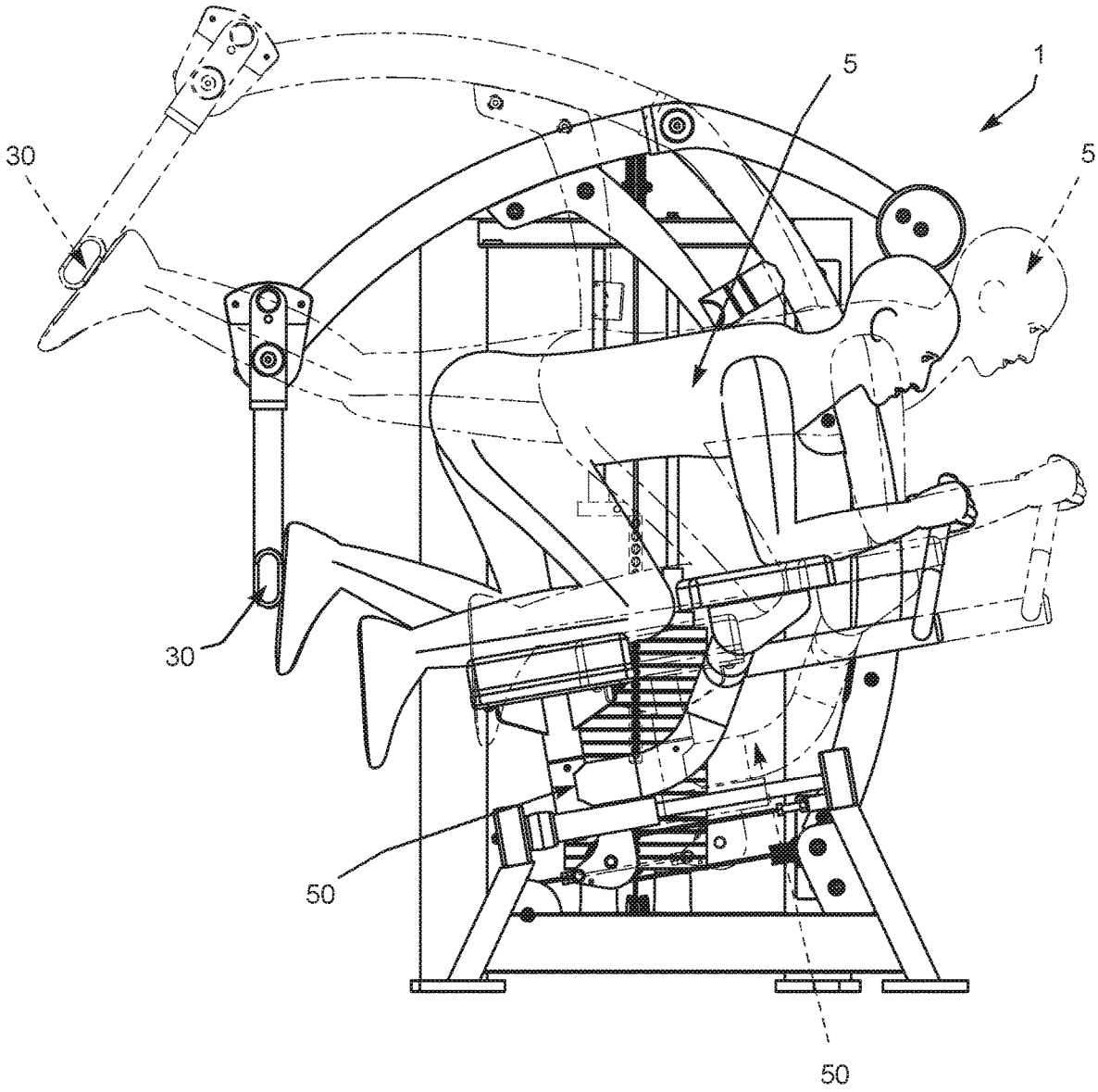
FIG. 12 is an elevation view of the glute machine in use with a person mounted thereon.

In FIGS. 7, 8, and 9, the glute machine 1 is shown in the start position, end position, and in use, respectively. In FIGS. 10, 11, and 12, the same positions are shown and illustrated, however with the person 5 mounted thereon. As such, various detail relating to the components and processes described hereinabove are illustrated in greater detail in FIGS. 7-12. More particularly, the carriage member 50, and its ability to translate in a linear fashion when the glute machine 1 is in use, is illustrated in FIGS. 7-12.

When the first cable 160 is activated by pushing rearwardly on the foot press bar 30, the carriage member 50 is put into motion in the manner described above. The carriage member 50 is preferably mounted on a track system 260. The track system 260 may be comprised of two substantially straight and bar members 265 that are parallel to one another and indirectly attached to the legs 70A, 70B via bracket members 270A, 270B, respectively (see FIG. 7). The carriage member 50, and more particularly, a lower portion 275 of the carriage member 50, preferably includes two sleeve members 280 for receiving and guiding the two parallel bar members 265 therein. FIGS. 7-12 illustrate one sleeve member 280 receiving one track member 265 therein because those drawings are illustrating an elevation view of the glute machine 1, but earlier drawings described hereinabove illustrate both sleeve members 280 having received the track members 265.

Preferably, the sleeves 280 have a diameter just greater than that of the parallel bars 265 that make up the track system 260. Thus, the sleeve members 280 which are rigidly attached to the carriage member 50 are preferably able to slide the length of the track system 260 by sliding along the bars 265 that make up the track system 265 when the first cable 160 drives movement of the carriage member 50 by way of the foot press bar 30. Other mechanisms for substantially linearly translating the carriage member 50 that are known or foreseeable in the art are also contemplated herein.

Figure 13:
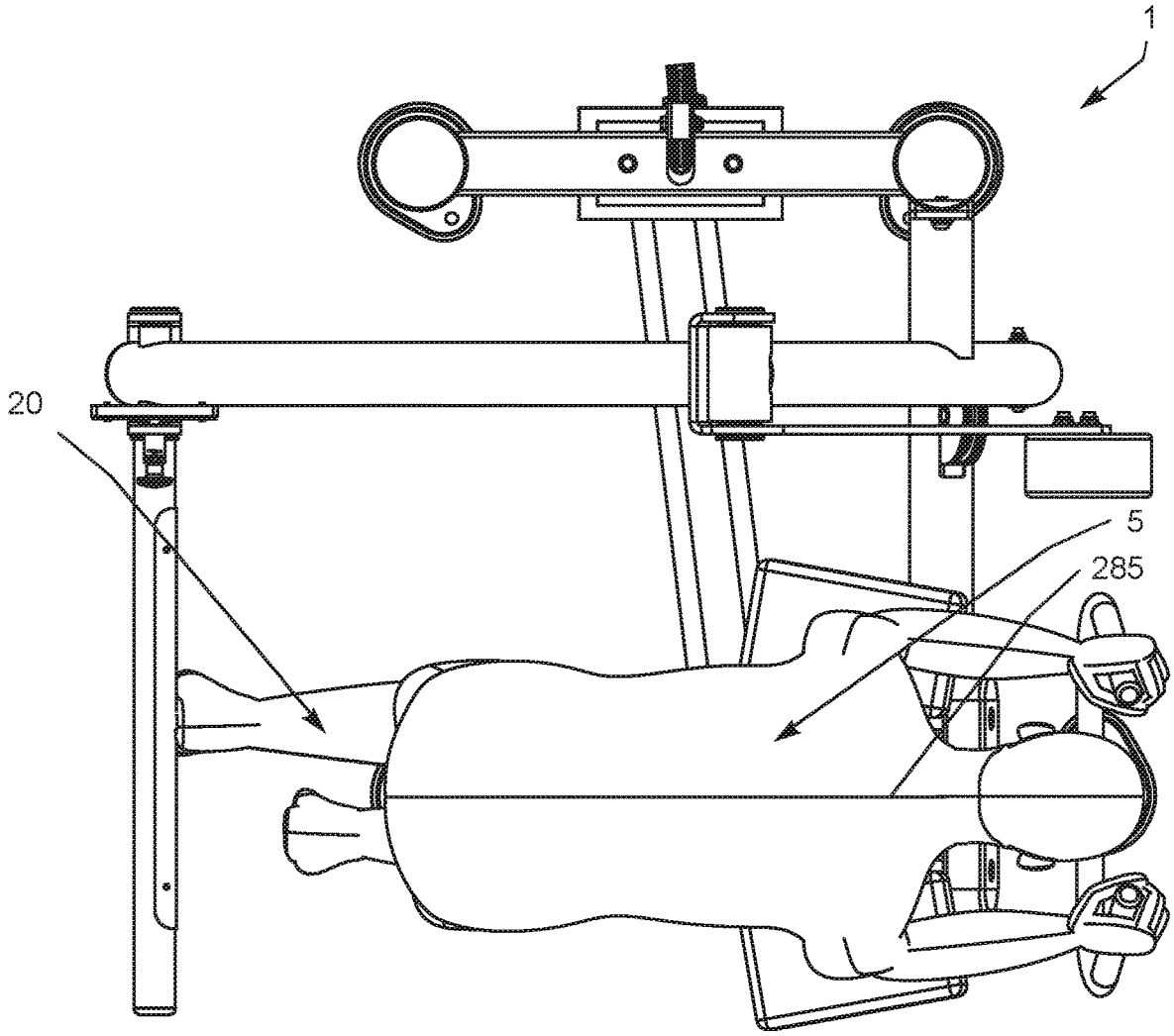
FIG. 13 is a plan view of the glute machine in the start position with a person mounted thereon.
Figure 14:
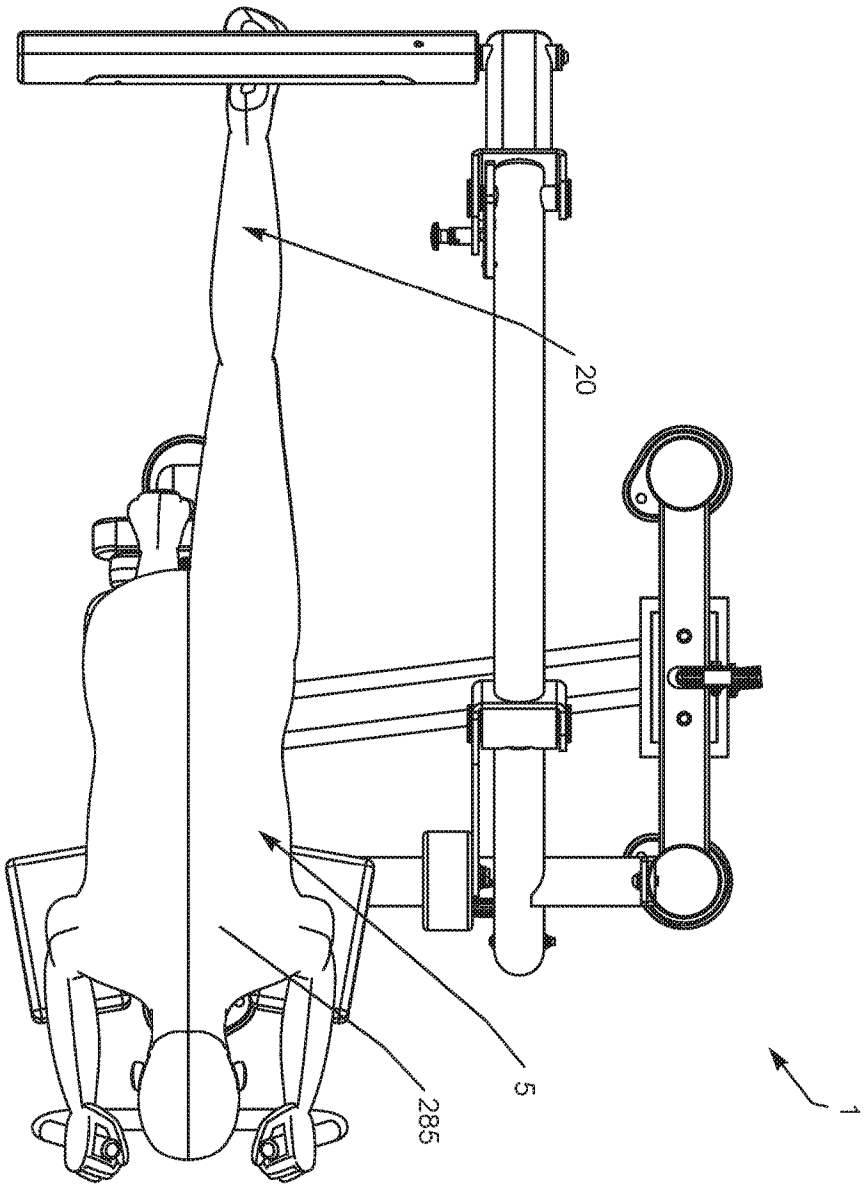
FIG. 14 is a plan view of the glute machine in the end position with a person mounted thereon.

As shown and illustrated, the bar members 265 are substantially straight. Thus, when the carriage member 50 is driven to translate by way of the first cable 160, the carriage member 50 preferably travels in a substantially linear path along the track system 260. The person 5 (and more particularly, an upper body 285 of the person 5) translates linearly forward with the carriage member 50 when in use. This motion preferably places the person 5 in the start position, end position, and positions in between illustrated in FIGS. 13, 14, and 15, respectively.

Figure 15:
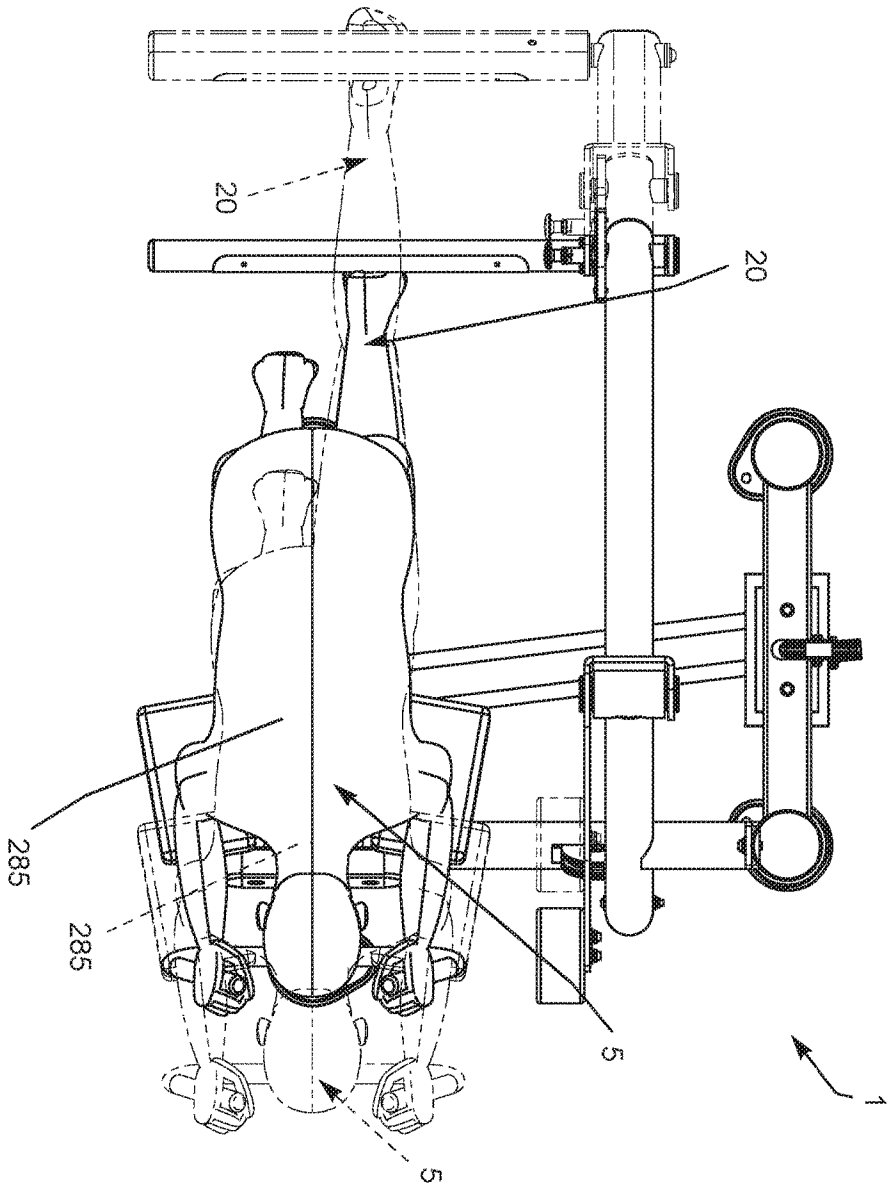
FIG. 15 is a plan view of the glute machine in use with a person mounted thereon.

With the carriage member 50 linearly translated forwardly in the manner shown in FIG. 15, the upper body 285 of the person 5 is also preferably linearly translated forwardly while the active leg 20 of the person 5 is extended rearwardly. This extension of the upper body 285 of a person 5 relative to the active leg 20 preferably extends the muscle length of a glute that is exercised during any given workout repetition. Increased muscle length during resistance training preferably increases the efficacy of a workout, and more particularly, in the case of the embodiment described herein, a workout aimed at improving strength of a glute muscle.

As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A resistance training machine, the machine comprising:

a foot press bar that may be pressed by a user of the machine and moved in a first direction;

a first cable coupled to the foot press bar at a first attachment point; and a carriage member including a user support attached to the carriage member and coupled to the first cable at a second attachment point;

wherein when the carriage member and the user support are in a first position, a surface of the user support lies in a plane;

wherein when the foot press bar is pressed in the first direction, the carriage member and the user support are linearly translated in a second direction and to a second position;

wherein when the carriage member and the user support are in the second position, the surface of the user support remains in the plane; and wherein the first direction is opposite of the second direction.

2. The machine of claim 1, wherein the machine includes a second cable and a weight stack, wherein the second cable is coupled to the carriage member at a first attachment point and to the weight stack at a second attachment point such that when the carriage member is linearly translated forwardly, weight is lifted from the weight stack via the second cable.

3. The machine of claim 1, wherein the carriage member is coupled to a track system on which the carriage member is linearly translatable.

4. The machine of claim 3, wherein the track system includes at least one bar on which the carriage member is linearly translatable.

5. The machine of claim 4, wherein the carriage member includes at least one sleeve member that receives and engages the at least one bar.

6. The machine of claim 1, wherein the machine includes an articulating arm member attached to and extending forwardly from the foot press bar.

7. The machine of claim 2, wherein the machine includes a disc member including the second attachment point of the first cable and the first attachment point of the second cable.

8. A resistance training machine, the machine comprising:

a user assembly, the user assembly including:

a carriage member including a user support attached to the carriage member that a user of the machine may mount when the machine is in use;

a track system on which the carriage member and the user support are linearly translatable; and a foot press bar coupled with the carriage member by a first cable portion; and a weight stack assembly including a weight stack, wherein the weight stack is coupled with the carriage member by a second cable portion, and wherein when the carriage member and the user support are in a first position, a surface of the user support lies in a plane;

wherein when the foot press bar is pressed rearwardly, the carriage member and the user support are linearly translated to a second position on the track system by the first cable portion and a weight of the weight stack is lifted by the second cable portion; and wherein when the carriage member and the user support are in the second position, the surface of the user support remains in the plane.

9. The machine of claim 8, wherein the user assembly includes a disc member to which each of the first cable portion and the second cable portion are attached.

10. The machine of claim 8, wherein the user assembly includes an articulating arm member attached to the foot press bar.

11. The machine of claim 8, wherein the carriage member includes a kneeling pad.

12. The machine of claim 8, wherein the carriage member includes a handle assembly.

13. A resistance training machine for exercising the glute muscles of a user, the machine comprising:

a foot press bar that may be rearwardly pressed by the user of the machine;

an articulating member coupled to the foot press bar, the articulating member including an extension member extending therefrom;

a first cable attached to the extension member at a first attachment point;

a carriage member including a user support attached to the carriage member and attached to the first cable at a second attachment point;

wherein when the carriage member and the user support are in a first position, a surface of the user support lies in a plane;

wherein when the foot press bar is rearwardly pressed, the carriage member and the user support are linearly translated forwardly to a second position via the first cable; and wherein when the carriage member and the user support are in the second position, the surface of the user support remains in the plane.

14. The machine of claim 13, wherein the machine includes a second cable and a weight stack, wherein the second cable is coupled to the carriage member at a first attachment point and to the weight stack at a second attachment point such that when the carriage member is linearly translated forwardly, weight is lifted from the weight stack via the second cable.

15. The machine of claim 13, wherein the carriage member is coupled to a track system on which the carriage member is linearly translatable.

16. The machine of claim 15, wherein the track system includes at least one bar on which the carriage member is linearly translatable.

17. The machine of claim 16, wherein the carriage member includes at least one sleeve member that receives and engages the at least one bar.

18. The machine of claim 14, wherein the machine includes a disc member including the second attachment point of the first cable and the first attachment point of the second cable.

19. The machine of claim 13, wherein the carriage member includes a kneeling pad.

20. The machine of claim 13, wherein the carriage member includes at least one of a handle assembly and at least one forearm pad.

21. A resistance training machine, the machine comprising:

a foot press bar that may be pressed by a user of the machine and moved in a first direction;

a first cable coupled to the foot press bar at a first attachment point; and a carriage member including a user support attached to the carriage member and coupled to the first cable at a second attachment point;

wherein when the foot press bar is pressed in the first direction, the carriage member and the user support are linearly translated in a second direction;

wherein the first direction is opposite of the second direction;

wherein the machine includes a second cable and a weight stack, wherein the second cable is coupled to the carriage member at a first attachment point and to the weight stack at a second attachment point such that when the carriage member is linearly translated forwardly, weight is lifted from the weight stack via the second cable; and wherein the machine includes a disc member including the second attachment point of the first cable and the first attachment point of the second cable.

22. A resistance training machine, the machine comprising:

a user assembly, the user assembly including:

a carriage member including a user support attached to the carriage member that a user of the machine may mount when the machine is in use;

a track system on which the carriage member and the user support are linearly translatable; and a foot press bar coupled with the carriage member by a first cable portion; and a weight stack assembly including a weight stack, wherein the weight stack is coupled with the carriage member by a second cable portion, wherein when the foot press bar is pressed rearwardly, the carriage member and the user support are linearly translated on the track system by the first cable portion and a weight of the weight stack is lifted by the second cable portion, and wherein the user assembly includes a disc member to which each of the first cable portion and the second cable portion are attached.

23. A resistance training machine for exercising the glute muscles of a user, the machine comprising:

a foot press bar that may be rearwardly pressed by the user of the machine;

an articulating member coupled to the foot press bar, the articulating member including an extension member extending therefrom;

a first cable attached to the extension member at a first attachment point;

a carriage member including a user support attached to the carriage member and attached to the first cable at a second attachment point;

wherein when the foot press bar is rearwardly pressed, the carriage member and the user support are linearly translated forwardly via the first cable, wherein the machine includes a disc member including the second attachment point of the first cable and the first attachment point of the second cable, and wherein the machine includes a second cable and a weight stack, wherein the second cable is coupled to the carriage member at a first attachment point and to the weight stack at a second attachment point such that when the carriage member is linearly translated forwardly, weight is lifted from the weight stack via the second cable.

* * * * *